US007717023B2

(12) United States Patent
Pereira et al.

(10) Patent No.: US 7,717,023 B2
(45) Date of Patent: May 18, 2010

(54) IMPROVISED EXPLOSIVE DEVICE DETECTION/DESTRUCTION/DISABLEMENT

(75) Inventors: Carlos M. Pereira, Tannersville, PA (US); Hai-Long Nguyen, Bethlehem, PA (US); Edip Niver, Mountainside, NJ (US); Aladin H. Kamel, Cairo (EG); Mohamed A. Salem, Harrison, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 1160 days.

(21) Appl. No.: 11/306,191

(22) Filed: Dec. 19, 2005

(65) Prior Publication Data

US 2008/0099692 A1 May 1, 2008

Related U.S. Application Data

(60) Provisional application No. 60/593,176, filed on Dec. 17, 2004.

(51) Int. Cl.
*F41H 11/12* (2006.01)

(52) U.S. Cl. ..... 89/1.13; 86/50

(58) Field of Classification Search ..... 89/1.13; 86/50; 250/393; 324/244
See application file for complete search history.

(56) References Cited

U.S. PATENT DOCUMENTS 3,978,396 A * 8/1976 Inouye et al. ..... 324/337
4,959,559 A * 9/1990 Ziolkowski ..... 359/896
4,975,912 A * 12/1990 Hogge ..... 367/96
5,361,675 A * 11/1994 Spektor et al. ..... 89/1.13
5,598,152 A * 1/1997 Scarzello et al. ..... 102/402
5,963,035 A * 10/1999 Won ..... 324/329
6,341,551 B1 * 1/2002 Comeyne ..... 89/1.13
6,609,451 B1 * 8/2003 Inoue et al. ..... 89/1.13
6,825,792 B1 * 11/2004 Letovsky ..... 342/14
6,870,498 B1 * 3/2005 Morgan et al. ..... 342/14
7,071,631 B2 * 7/2006 Howard, II ..... 315/236
2004/0232847 A1 * 11/2004 Howard, II ..... 315/111.51

* cited by examiner

*Primary Examiner*—Michael Carone
*Assistant Examiner*—Jonathan C Weber
(74) *Attorney, Agent, or Firm*—John F. Moran

(57) ABSTRACT

Apparatus and accompanying methods for the detection and subsequent destruction or disablement of Improvised Explosive Devices (IEDs) while maintaining a satisfactory level of human safety. Operationally, our inventive method and apparatus detects the IED using one or more methods including: detecting internal battery components; detecting magnetic signature(s) of the IED; detecting a characteristic energy spectrum of the IED; and/or detecting characteristic chemical signatures of the device(s). Once detected, the device may be further characterized and then subsequently deactivated and/or destroyed by a shaped pulse charge directed at the device or its power source (battery) from a safe distance.

8 Claims, 4 Drawing Sheets

R1: Detection of Internal Battery Components
Detection of Magnetic Signature
Detection of Energy Spectrum

R2: Elimination of Power Source From a Greater Distance

R1: Detection of Internal Battery Components
Detection of Magnetic Signature
Detection of Energy Spectrum R2: Elimination of Power Source From a Greater Distance

IMPROVISED EXPLOSIVE DEVICE DETECTION/DESTRUCTION/DISABLEMENT

CROSS REFERENCE TO RELATED APPLICATION

This application claims the benefit under 35 USC 119(e) of U.S. Provisional Patent Application No. 60/593,176 filed Dec. 17, 2004 the entire file wrapper contents of which provisional application are herein incorporated by reference as though set forth at length.

UNITED STATES GOVERNMENT INTEREST

The inventions described herein may be manufactured, used and licensed by or for the U.S. Government for U.S. Government purposes.

FEDERAL RESEARCH STATEMENT

The invention described herein may be made, used, licensed by or for the United States Government for government purposes without payment of any royalties thereon or therefore.

FIELD OF THE INVENTION

This invention relates generally to the detection and destruction and/or disablement of explosives and in particular to apparatus and accompanying methods for the detection and destruction and/or disablement of Improvised Explosive Devices (IEDs).

BACKGROUND OF THE INVENTION

Enemies of the United States have resorted to the use of improved explosive devices often made from widely available components to attack, disrupt U.S. personnel and assets. The devices being used for remote control activate and detonate such destructive actions in general use electronics that require power. A promising strategy is to detect, deactivate, disrupt and eliminate the power source from providing energy to the IED sensing and actuation electronics and related power supply components.

SUMMARY OF THE INVENTION

We have developed—in accordance with the teachings of the present invention—apparatus and accompanying methods for the detection and subsequent destruction or disablement of Improvised Explosive Devices (IEDs) while maintaining a satisfactory level of human safety.

Operationally, our inventive method and apparatus detects the IED using one or more methods including: detecting internal battery components; detecting magnetic signature(s) of the IED; detecting a characteristic energy spectrum of the IED; and/or detecting characteristic chemical signatures of the device(s). Once detected, the device may be further characterized and then subsequently deactivated and/or destroyed by a shaped pulse charge directed at the device or its power source (battery) from a safe distance.

In a preferred embodiment, the shaped pulse charge is generated and subsequently directed through the effect of a number of open ended waveguides, the energies from which combine at the IED target, thereby achieving maximal effect.

Advantageously, since our shaped pulse charge is most energetic at the location of the IED target, its collateral effect on nearby structures is minimized.

According to our inventive teachings, the detection of an IED is performed at a safe radial distance from the device. Subsequent disablement and/or destruction of the device is performed from a safe radial distance, which may be even further than the detection distance.

BRIEF DESCRIPTION OF THE DRAWING

Various features and advantages of the present invention and the manner of attaining them will be described in greater detail with reference to the following description, claims and drawing wherein:

DETAILED DESCRIPTION

Figure 1:
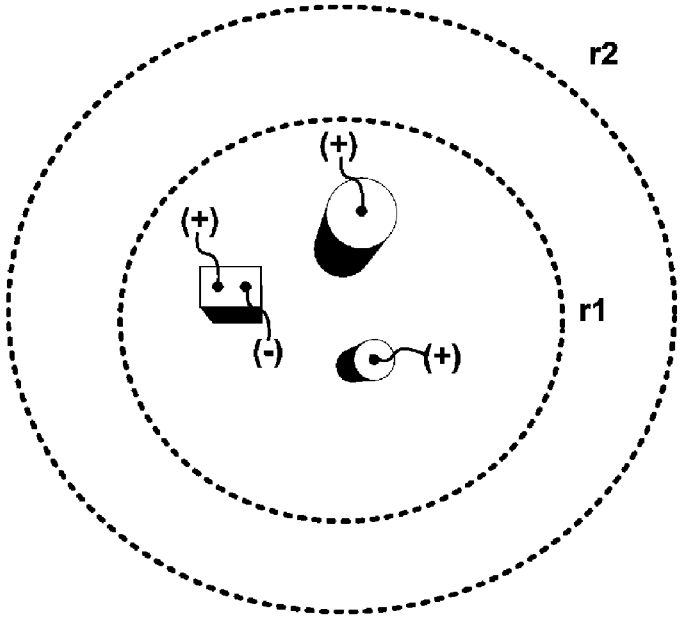
FIG. 1 is an overhead view of a power source for an IED and radial distances from which detection and/or destruction/disablement would occur according to the present invention.

As can be readily appreciated by those skilled in the art, batteries or other portable power sources are used to provide power for communication, triggering and other IED functions requiring electrical energy. In principle, nearly all types of batteries, both primary (non-rechargeable) and secondary (rechargeable) can be used for such IEDs.

Due to their ready availability, most of the crude IEDs likely to be encountered in the field employ batteries that are commercially available, such as cell phone batteries (Ni—Cd, Ni-MH, and Li-ion), Leclanché and other manganese-containing batteries, and dry cells. All of these batteries have a characteristic magnetic signature, which depends on the inherent magnetic properties of the materials used in battery construction.

For example, batteries with nickel or its compounds are ferromagnetic, as are materials used in most Li-ion batteries, and thus are readily detected over short distances. Other materials are more difficult to detect, such as the carbon in Leclanché and Li-ion batteries. Fortunately however, for our purposes, the containers of such batteries are detectable as they usually employ steel or nickel materials. Consequently, the detection of batteries can be usually be accomplished reliably through their magnetic signature. Of course, other battery detection methods are known and available, including radar and chemical means.

Similarly, the destruction or disablement of batteries used in IEDs can also be performed in a variety of ways. For example, the materials that comprise a battery (either active materials within the cell, or various support materials) may preferentially absorb electromagnetic radiation of different wavelengths, depending on the material properties.

Likewise, control circuits used to operate/and or regulate the battery can also be disrupted or destroyed. Consequently, the wavelengths that are preferably absorbed for materials present in common batteries must be identified and characterized.

As can be appreciated, the energy stored in the power supply of IED electronics is used to operate proximity and/or triggering electronics, communications with other IED devices or communications with terrorism data gathering networks. Command and control electronics of such devices may in fact actually control and detonate any number of IED devices.

Of further significance, power supplies have one or more component(s) that perform two functions to reduce the potential difference, the current or filter spurious power supply noise. For example, during the sudden operation of a radio transmitter, the peak power from the power supply to operate the transmission system suddenly ramps up, providing an electromagnetic signature immediately followed by the operation of the radio. Both of these electromagnetic signatures will typically not occur in the same frequency regime, and each will have very distinct characteristics but will exhibit a time correlation. Consequently, such events may be used advantageously—for the preliminary detection of IED's—a necessary prerequisite to their disablement and/or destruction.

Although the detection of an IED is of considerable benefit, it is nevertheless the destruction or disablement of the IED that is most desirable. One well known method of destruction or disablement is the detonation of the device, leading to its self destruction. In the case of a device triggered electronically, this could in many cases be performed by triggering the device using radar or appropriate microwave transmitters (at least for the crude devices likely encountered presently). Alternative detonation methods include mechanically disturbing the IED until it detonates.

While a battery or power source of an IED is detectable, it is generally more difficult to deactivate than the triggering mechanism or other parts of the IED. However, the control circuit associated with the battery or power supply is vulnerable to being disrupted by external means such as a RADAR system or by a sharp, directed increase in a nearby electrical field.

Turning now to FIG. 1, there is shown an overhead plan view of an area representative of that in which an Improvised Explosive Device(s) is/are placed. For the purposes of this discussion, the IED is positioned at the center of the FIG. 1. One or more power sources/supplies (batteries) are depicted at the center of that figure as well.

As noted earlier, the detection of the battery or other power source may be effected by a number of mechanisms. One, the internal battery components may be detected by its magnetic signature and/or its energy spectrum. In addition, such signatures may accompany additional transmission/emanations, such as those which correspond to a command/control signal (s) or data relaying operation using a transmitter.

As taught by the present invention, once such a signature is obtained and a battery or other power source is detected, (which, preferably is performed at a radial distance depicted in the FIG as r1), the elimination of the power source may be performed at a greater radial distance, r2, thereby ensuring the safety of any personnel performing such task(s).

Figure 2:
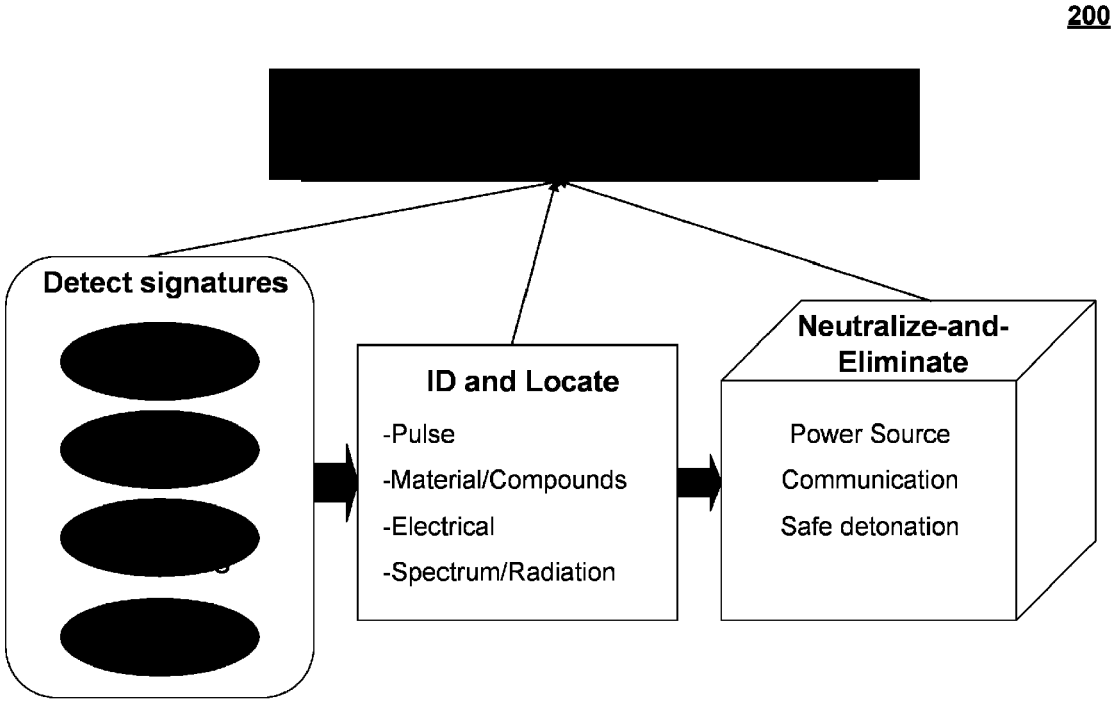
FIG. 2 is a block diagram depicting the overall methodology of the present invention.

Turning our attention now to FIG. 2, there is shown a block diagram depicting the overall strategy of our inventive structure and accompanying method(s). In particular, a first step in identifying and locating the IED is performed via one or more methods including introducing a pulse of energy into the area and observing whether any particular characteristic signatures result. Consequently, material signatures as well as electromagnetic signatures resulting from an IEDs response to a pulse of electromagnetic energy, or its electromagnetic transmission, and/or any spectra or radiative energy produced is detected.

As part of that characteristic detection schemes, observations/detections are made searching for any characteristic electromagnetic, chemical, back scatter and/or infrared signatures that are associated with particular IED's and/or their power sources. As can be readily appreciated, such detection schemes are not mutually exclusive, and we preferably employ them in combinations that produce a wider-range of reliable results.

Once a candidate IED is detected/and located, it is subsequently neutralized—according to our inventive teachings—through the effect of a shaped electromagnetic pulse directed at the IED device in such a manner that maximum energy is imparted onto/into the IED device and not its surroundings. Advantageously, RF waveguide structures may be employed to produce and subsequently direct the pulse(s) of electromagnetic energy to the IED target.

Figure 3:
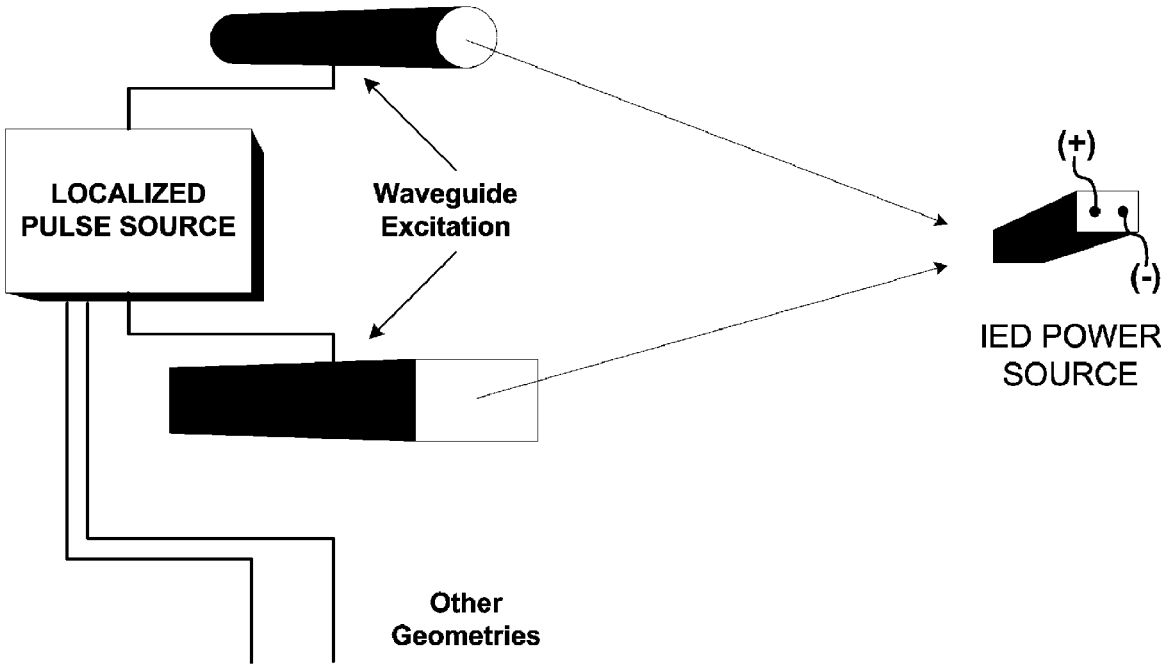
FIG. 3 is a block diagram depicting the destruction/disablement of the IED according to the present invention.

Turning now to FIG. 3, there is shown a block diagram depicting our inventive structures and method(s). More particularly, shown in that FIG. 3 is an IED power source, and our localized pulse source generator and waveguide excitation structures.

As noted prior, the IED may be detected in a number of ways, including the detection of a characteristic chemical and/or electromagnetic or magnetic signature(s). And while this FIG. 3 only shows the IED power source, we are not so limiting as to imply that it is the power source we are necessarily detecting. Any of a number of characteristic signatures, emanating or otherwise resulting from the IED, may provide such detection/location. Rather, we show the IED power source here because that is the structure at which our inventive shaped pulse is directed to.

By way of some additional background at this point, there has been extensive theoretical research describing localized waves (LW) in the form of a space-time localized pulse generation and propagation in homogeneous/inhomogeneous dispersive and non-dispersive media. (See., e.g, J. B. Brittingham, "Focus Waves Modes in Homogeneous Maxwells' Equations: Transverse Electric Mode" which appeared in J. Applied Physics, vol. 54, pp 1179 in 1983 and R. W. Ziolkowski et al, "Localoized Wave Representations of Acoustic and Electromagnetic Radiation", which appeared in IEEE Proceedings, Vol. 79, No. 10, pp. 1371-1378, in 1991; the entire contents and teachings of which are incorporated herein by reference as if they were in length)

Accordingly, and consistent with the teachings of the instant invention, a space/time localized pulse is synthesized at a distance r1 from the source location (IED device). The pulse is realized through the effect(s) of a number of horn/open ended waveguide antennas excited with pre-determined modes that cover a bandwidth sufficient to produce a localized wave. Consequently, once the IED is detected and its approximate location is determined, the localized waves (LW) source is adjusted to produce a pulse of high intensity at that location. The pulse then destroys/deactivates the IED. Inasmuch as the highest intensity of the pulse is produced at the specific location of the IED, adjacent structures and/or materials are minimally affected. The distance r2 in FIG. 1 is between 50-100 feet and the intensity of the power is at least 1 watt.

Figure 4:
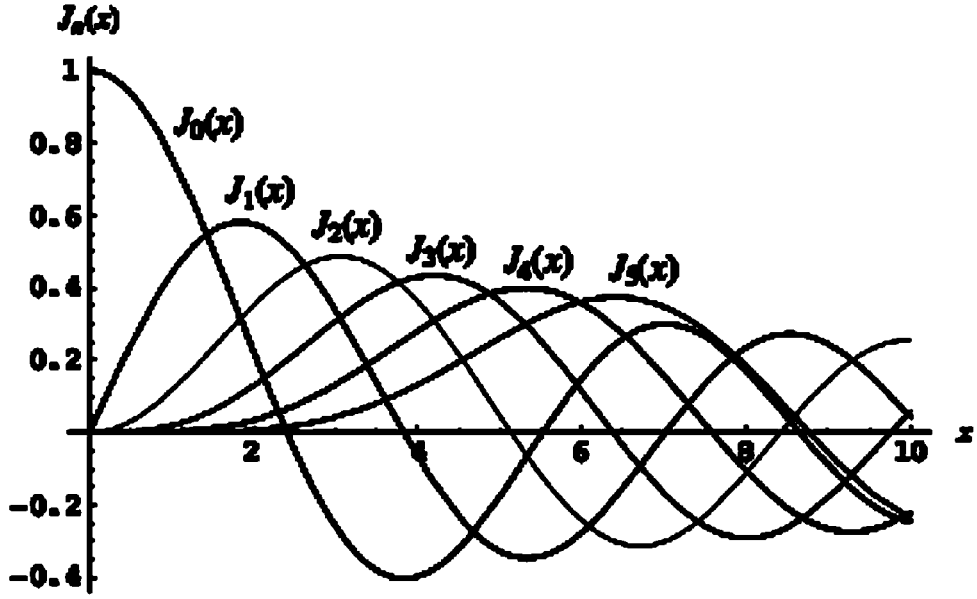
FIG. 4 is a graph showing the combined Bessel functions as applied to a shaped pulse, underlying the destruction/disablement of the IED according to the present invention.

The combination of the radiative pulses emitted from each of the number of open waveguide structures are combined in a Bessel-like manner (see FIG. 4) such their combination is greatest at the location of the IED. In this manner, the waveguides serve as a mechanism in which particular modes of EM pulses are established, and directional energy is produced wherein the non-destructive modes are restricted.

Of course, it will be readily understood by those skilled in the art that the foregoing is merely illustrative of the principles of this invention, and that various modifications may be made by those skilled in the art without departing from the scope and spirit of the invention. In particular, any number of waveguide structures may be provided for the waveguide excitation, and advantageously they may be of any particular shape. More specifically, while we have only shown cylindrical and substantially rectangular waveguides, other shapes are contemplated within our inventive teachings. Still further, any number of detection mechanisms and resulting IED signatures are envisioned. Accordingly, our invention is to be limited only by the scope of the claims attached hereto.

What is claimed is:

1. A method for the detection and destruction/disablement of Improvised Explosive Devices (IED) comprising the steps of: directly detecting the existence of a battery in the IED; determining, the location of the detected battery and the IED; and disabling the IED, by directing one or more shaped pulses of electromagnetic energy at the IED such that substantially the maximum energy of the pulse is realized at the location of the IED device and not at other locations.

2. The method of claim 1 wherein said detecting step comprises the step(s) of: Pulsing an area containing the IED with a test pulse of electromagnetic energy; and Detecting a characteristic signature of the IED including the battery in response to the test pulse.

3. The method of claim 1 wherein said detecting step comprises: Individually detecting, through the effect of a plurality of sensors, sensor specific information; Integrating the sensor specific information into a fused signal; and determining, the existence of the IED including the battery from the information within the fused signal.

4. The method of claim 1 wherein said shaped electromagnetic pulse(s) are produced through the effect of a plurality of RF waveguide structures, each of said waveguide structures having a characteristic shape.

5. The method of claim 4 wherein each one of said plurality of RF waveguide structures has a unique, characteristic shape.

6. The method of claim 4 wherein said shaped pulse has at least 1 watt of power at a distance of between 50-100 ft.

7. The method of claim 4 wherein said shaped pulse is directed at a location of the power source of the IED.

8. The method of claim 4 wherein a radial distance r1 from the IED where detected, is less than a radial distance r2 from the IED when destroyed.

* * * * *